US009573390B2

(12) United States Patent
Sasaki

(10) Patent No.: US 9,573,390 B2
(45) Date of Patent: Feb. 21, 2017

(54) RECORDING APPARATUS WITH ELECTROMAGNETIC WAVE IRRADIATOR

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 27 days.

(21) Appl. No.: 14/323,720

(22) Filed: Jul. 3, 2014

(65) Prior Publication Data

US 2015/0009269 A1 Jan. 8, 2015

(30) Foreign Application Priority Data

Jul. 8, 2013 (JP) ..... 2013-142409

(51) Int. Cl.
*B41J 11/00* (2006.01)
*B41J 11/057* (2006.01)

(52) U.S. Cl.
CPC ..... *B41J 11/002* (2013.01); *B41J 11/0015* (2013.01); *B41J 11/057* (2013.01)

(58) Field of Classification Search
CPC ..... B41J 11/002; B41J 11/0015; B41J 11/057
USPC ..... 347/104, 101, 16
See application file for complete search history.

(56) References Cited

U.S. PATENT DOCUMENTS 5,579,693 A * 12/1996 Carreira ..... B41F 23/00 101/487
5,712,672 A * 1/1998 Gooray ..... B41J 2/01 219/691
6,116,728 A * 9/2000 Miyake ..... B41J 3/4078 347/102
2005/0151815 A1* 7/2005 Kanai ..... B41J 11/002 347/102

FOREIGN PATENT DOCUMENTS

| | | |
|---|---|---|
| JP | 2009-073023 | 4/2009 |
| JP | 2009-233858 | 10/2009 |
| JP | 4429923 | 12/2009 |
| JP | 2012-045855 | 3/2012 |
| JP | 2012-232532 | 11/2012 |
| JP | 2013-028094 | 2/2013 |
| WO | 2012/153694 | 11/2012 |

* cited by examiner

*Primary Examiner* — Henok Legesse
(74) *Attorney, Agent, or Firm* — Workman Nydegger

(57) ABSTRACT

A recording apparatus includes a medium supporting portion that supports a recording target medium, and an electromagnetic wave irradiator that emits electromagnetic waves onto the recording target medium on the medium supporting portion and dries ink present on the recording target medium using the electromagnetic waves. In the recording apparatus, the medium supporting portion has a thermal conductivity of equal to or higher than 0.057 w/(m·K) and equal to or lower than 2.2 w/(m·K).

11 Claims, 5 Drawing Sheets

RECORDING APPARATUS WITH ELECTROMAGNETIC WAVE IRRADIATOR

BACKGROUND

1. Technical Field

The present invention relates to a recording apparatus including a medium supporting portion that supports a recording target medium and an electromagnetic wave irradiator that emits electromagnetic waves onto the recording target medium on the medium supporting portion.

2. Related Art

Existing recording apparatuses including a heater that dries ink discharged onto a recording target medium for recording have been used. Among them, a recording apparatus including an electromagnetic wave irradiator that emits electromagnetic waves onto a recording target medium for drying ink discharged onto the recording target medium has been used in many cases. For example, JP-A-2013-28094 and JP-A-2012-45855 disclose recording apparatuses including a heater that emits electromagnetic waves, such as a halogen heater and a sheathed heater.

JP-A-2013-28094 and JP-A-2012-45855 disclose a platen that supports a recording target medium on a recording region by a recording head in a transportation path of the recording target medium and the heater corresponding to the position of the platen. Further, JP-A-2013-28094 discloses a downstream platen made of aluminum alloy, which is provided in the transportation path at the downstream side with respect to the recording region in the transportation direction of the recording target medium, and a heater (so-called after-heater) corresponding to the position of the downstream platen. Thus, the existing recording apparatus including the so-called after-heater for drying ink discharged onto the recording target medium on which recording has been performed in the transportation path at the downstream side with respect to the recording region in the transportation direction of the recording target medium has been used.

However, in the existing recording apparatus including the after-heater of such a type that it emits electromagnetic waves such as infrared rays as disclosed in JP-A-2013-28094, steam evaporated from the ink discharged onto the recording target medium by the after-heater is condensed on the medium supporting portion and the recording target medium gets wet in some cases.

SUMMARY

An advantage of some aspects of the invention is to provide a recording apparatus for suppressing condensation of steam evaporated from ink with electromagnetic wave irradiation on a medium supporting portion.

A recording apparatus according to a first aspect of the invention includes a medium supporting portion that supports a recording target medium, and an electromagnetic wave irradiator that emits electromagnetic waves onto the recording target medium on the medium supporting portion and dries ink present on the recording target medium using the electromagnetic waves, and the medium supporting portion has a thermal conductivity of equal to or higher than 0.057 w/(m·K) and equal to or lower than 2.2 w/(m·K).

The medium supporting portion is a medium supporting portion that supports the recording target medium in a state where a recording operation on the recording target medium has been completed.

According to the aspect of the invention, the medium supporting portion has the thermal conductivity of equal to or higher than 0.057 w/(m·K) and equal to or lower than 2.2 w/(m·K). Therefore, the medium supporting portion has the thermal conductivity that is lower than the thermal conductivity of the existing medium supporting portion made of aluminum alloy, which is approximately 230 w/(m·K), for example. This can decrease difference in the temperature between a region to which the electromagnetic waves are emitted and a region to which the electromagnetic waves are not emitted. That is to say, condensation of steam evaporated from the ink with the electromagnetic wave irradiation on the medium supporting portion can be suppressed.

A recording apparatus according to a second aspect of the invention includes a medium supporting portion that supports a recording target medium, and an electromagnetic wave irradiator that emits electromagnetic waves onto the recording target medium on the medium supporting portion and dries ink present on the recording target medium using the electromagnetic waves, and the medium supporting portion has a thermal conductivity of equal to or higher than 0.057 w/(m·K) and equal to or lower than 30 w/(m·K), and the medium supporting portion includes an opening through which steam evaporated from ink discharged onto the recording target medium with electromagnetic wave irradiation by the electromagnetic wave irradiator passes.

The term "opening" in the expression "opening through which steam evaporated from ink passes" can cause the evaporated steam to pass therethrough from the recording target medium side with respect to the medium supporting portion to the opposite side.

According to the aspect of the invention, the thermal conductivity is as low as equal to or higher than 0.057 w/(m·K) and equal to or lower than 30 w/(m·K) and the medium supporting portion includes the opening through which the steam evaporated from the ink passes. This allows the steam evaporated from the ink with the electromagnetic wave irradiation to pass through the opening in the direction of being farther from a portion of the medium supporting portion which opposes the recording target medium, that is, a contact region between the medium supporting portion and the recording target medium. Therefore, condensation of the steam evaporated from the ink with the electromagnetic wave irradiation on a portion of the medium supporting portion which opposes the recording target medium can be suppressed.

In the recording apparatus according to a third aspect of the invention, it is preferable in the second aspect of the invention that the recording apparatus include a condensation portion that causes the steam which has passed through the opening to be condensed on the condensation portion.

According to the aspect of the invention, the medium supporting portion is provided with the opening through which the steam evaporated from the ink passes, and includes the condensation portion that causes the steam which has passed through the opening to be condensed thereon. Therefore, the steam can be condensed on the condensation portion before the steam evaporated from the ink is condensed on the medium supporting portion. That is to say, condensation of the steam evaporated from the ink with the electromagnetic wave irradiation on the medium supporting portion can be suppressed more effectively.

In the recording apparatus according to a fourth aspect of the invention, it is preferable in the third aspect of the invention that a thermal conductivity of the condensation portion be higher than the thermal conductivity of the medium supporting portion.

According to the aspect of the invention, the thermal conductivity of the condensation portion is higher than the thermal conductivity of the medium supporting portion. That is to say, the condensation portion is made of a material that causes the steam to be condensed easily thereon in comparison with the medium supporting portion. Therefore, the steam evaporated from the ink with the electromagnetic wave irradiation can be condensed on the condensation portion effectively. This can suppress condensation of the steam on the medium supporting portion more effectively.

In the recording apparatus according to a fifth aspect of the invention, it is preferable in any one of the first to fourth aspects of the invention that a heat resistant temperature of the medium supporting portion be equal to or higher than 60° C.

The term "heat resistant temperature" is a temperature determined based on a test method defined by ASTM D-648.

The intensity of the electromagnetic wave irradiation by the electromagnetic wave irradiator is determined such that the temperature of the medium supporting portion does not become equal to or higher than the heat resistant temperature. According to the aspect of the invention, the intensity of the electromagnetic wave irradiation by the electromagnetic wave irradiator is adjusted based on the heat resistant temperature of the medium supporting portion and the curing temperature of ink containing curable resin. Therefore, the number of types of ink components capable of being used is increased. For example, ink containing curable resin that cures at approximately 60° C. can be used. This enables the recording medium to be transported stably without generating condensation of the steam evaporated from ink even when ink that cures at the low temperature or ink that cures at the high temperature is used.

In the recording apparatus according to a sixth aspect of the invention, it is preferable in any one of the first to fifth aspects of the invention that a rear side of a supporting surface of the medium supporting portion which supports the recording target medium make contact with a heat conductive member.

According to the aspect of the invention, the rear side of the supporting surface of the medium supporting portion, which supports the recording target medium, makes contact with the heat conductive member. Therefore, the heat conductive member can absorb heat of the medium supporting portion so as to improve the heat dissipation property of the medium supporting portion. That is to say, for example, heat dissipation time from time at which the recording apparatus is powered OFF can be reduced.

In the recording apparatus according to a seventh aspect of the invention, it is preferable in any one of the first to sixth aspects of the invention that the recording apparatus include a transportation mechanism that transports the recording target medium, the medium supporting portion include a contact portion that makes contact with and supports the recording target medium and a non-contact portion that does not make contact with the recording target medium and is provided with the opening, and the contact portion and the non-contact portion be provided to extend in an intersecting direction intersecting with a transportation direction of the recording target medium by the transportation mechanism and be provided to be positioned alternately in the transportation direction.

According to the aspect of the invention, the contact portion and the non-contact portion are provided to extend in the direction intersecting with the transportation direction, and are provided to be positioned alternately in the transportation direction. Therefore, the medium supporting portion can make line-contact with the recording target medium that is transported in the transportation direction. That is to say, condensation of the steam on the medium supporting portion can be suppressed and friction force when the recording target medium is transported can be reduced in comparison with a recording apparatus that transports the recording target medium while the recording target medium is made to make surface-contact with the medium supporting portion.

In the recording apparatus according to an eighth aspect of the invention, it is preferable in the seventh aspect of the invention that the contact portion be formed by arranging a plurality of projections having apexes as contact parts with the recording target medium.

According to the aspect of the invention, the contact portion is formed by arranging the plurality of projections having the apexes as the contact parts with the recording target medium. Therefore, the medium supporting portion can make point-contact with the recording target medium that is transported in the transportation direction by the plurality of projections. That is to say, condensation of the steam on the medium supporting portion can be suppressed and friction force when the recording target medium is transported can be reduced in comparison with a recording apparatus that transports the recording target medium while the recording target medium is made to make surface-contact or line-contact with the medium supporting portion.

In the recording apparatus according to a ninth aspect of the invention, it is preferable in any one of the first to eighth aspects of the invention that the recording apparatus include a transportation mechanism that transports the recording target medium, and an irradiation length of the electromagnetic waves by the electromagnetic wave irradiator in the intersecting direction intersecting with the transportation direction of the recording target medium by the transportation mechanism correspond to a length of the medium supporting portion in the intersecting direction.

The expression "length of the medium supporting portion in the intersecting direction" may be a length including an outer frame when the medium supporting portion includes the outer frame or the like or may be a length of a region in which the opening is provided without including the outer frame.

The expression "correspond to a length of the medium supporting portion in the intersecting direction" indicates that the irradiation length is equivalent to or larger than the length of the medium supporting portion in the intersecting direction. The term "equivalent" indicates to also include the case where the irradiation length is slightly smaller than the length of the medium supporting portion in the intersecting direction.

According to the aspect of the invention, the irradiation length of the electromagnetic waves by the electromagnetic wave irradiator in the intersecting direction corresponds to the length of the medium supporting portion in the intersecting direction. Therefore, difference in the temperature on the medium supporting portion in the intersecting direction can be decreased, thereby suppressing generation of condensation on end portions and the like of the medium supporting portion in the intersecting direction.

A recording apparatus according to a tenth aspect of the invention includes an electromagnetic wave irradiator that performs heating operation using electromagnetic waves, and a medium supporting portion that supports a recording target medium on which recording has been performed on an irradiation region of the electromagnetic wave irradiator, and the medium supporting portion is configured to reduce condensation of steam evaporated from ink discharged onto the recording target medium with electromagnetic wave irradiation by the electromagnetic wave irradiator on a portion of the medium supporting portion which opposes the recording target medium.

The expression "configured to reduce condensation" is used not to indicate that the steam is required not to be condensed on the medium supporting portion at all but to indicate as follows. That is, condensation to an extent that liquid condensed on the medium supporting portion is not recognized as contaminants raises no problem even if the liquid attaches to the recording target medium.

According to the aspect of the invention, the medium supporting portion is configured to reduce condensation of the steam evaporated from the ink discharged on the recording target medium with the electromagnetic wave irradiation by the electromagnetic wave irradiator. Therefore, a problem that the steam evaporated from the ink with the electromagnetic wave irradiation is condensed on the medium supporting portion and contaminates the recording target medium can be suppressed.

In the recording apparatus according to an eleventh aspect of the invention, it is preferable in the tenth aspect of the invention that the medium supporting portion be made of a plastic material.

According to the aspect of the invention, the medium supporting portion is made of the plastic material, so that it can be processed easily.

In the recording apparatus according to a twelfth aspect of the invention, it is preferable in the eleventh aspect of the invention that the plastic material be any one of polyether ether ketone, polyphenylene sulfide, and Bakelite.

According to the aspect of the invention, the medium supporting portion can be processed easily and enhances a condensation suppressing effect.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

FIG. 1 and FIG. 2

Hereinafter, a recording apparatus in a first embodiment is described in detail with reference to the accompanying drawings.

First, the recording apparatus according to the embodiment is described. The recording apparatus is a recording apparatus that can perform recording on a recording target medium with aqueous ink but is not limited to the recording apparatus that can use the aqueous ink.

Figure 1:
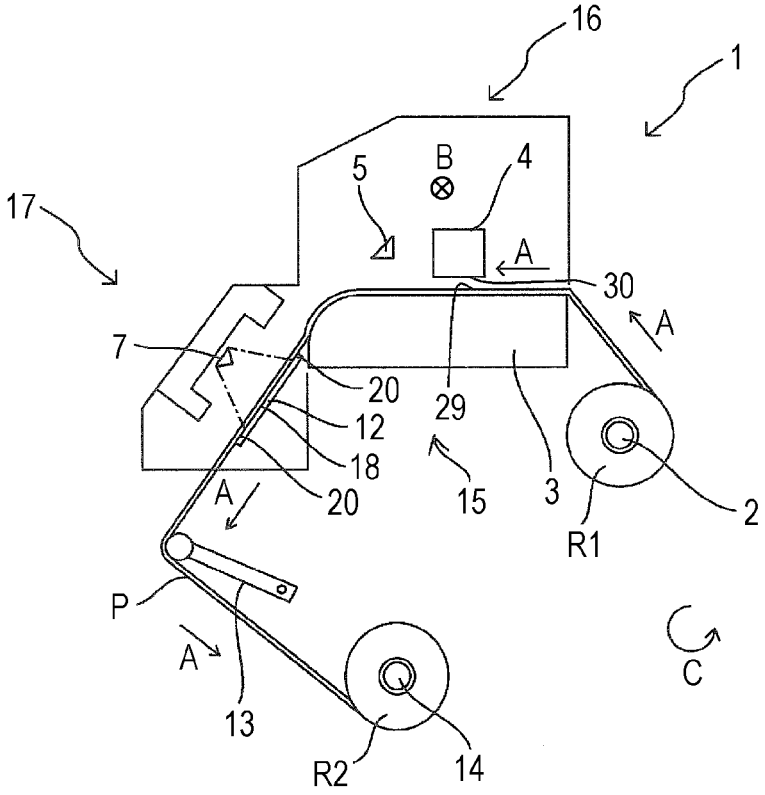
FIG. 1 is a schematic side view illustrating a recording apparatus according to a first embodiment of the invention.

FIG. 1 is a schematic side view illustrating a recording apparatus 1 according to the embodiment.

The recording apparatus 1 in the embodiment includes a set portion 2 on which a roll R1 can be set so as to feed a recording target medium P for recording. The recording apparatus 1 in the embodiment uses a roll-form recording target medium as the recording target medium P. However, the invention is not limited to the recording apparatus that uses the roll-form recording target medium. For example, a single sheet-form recording target medium may be used.

When the recording apparatus 1 in the embodiment transports the recording target medium P in a transportation direction A, the set portion 2 rotates in a rotating direction C.

The recording apparatus 1 in the embodiment includes a transportation mechanism 15. The transportation mechanism 15 includes a plurality of transportation rollers (not illustrated) for transporting the roll-form recording target medium P in the transportation direction A in the vicinity of a platen 3. If the set portion 2 rotates in the rotating direction C, the plurality of transportation rollers (not illustrated) of the transportation mechanism 15 rotate, and a wind-up portion 14, which will be described later, rotates in the rotating direction C, the recording target medium P is transported in the transportation direction A. A movement path of the recording target medium P when transported is a transportation path of the recording target medium P.

The recording apparatus 1 in the embodiment includes a recording mechanism 16. The recording mechanism 16 causes a recording head 4 to reciprocate in a scanning direction B intersecting with the transportation direction A of the recording target medium P so as to perform recording. The recording head 4 discharges ink through nozzles onto the recording target medium P so as to perform recording on a recording region 29 in the transportation path of the recording target medium P by the transportation mechanism 15. An image is formed (recorded) on the recording target medium P with the ink discharged from the recording head 4. The recording apparatus 1 in the embodiment includes the recording mechanism 16 that causes the recording head 4 to reciprocate so as to perform recording but may be a recording apparatus including a so-called line head in which a plurality of nozzles for discharging ink are provided in the direction intersecting with the transportation direction A.

A region opposing the recording head 4 when recording is performed on the recording target medium P corresponds to the recording region 29. To be specific, a region opposing a formation region of the nozzles (not illustrated) for discharging the ink, which is provided on a nozzle formation surface 30 of the recording head 4, corresponds to the recording region 29. It should be noted that the recording mechanism 16 is provided with a platen heater 5 of an electromagnetic wave irradiation type. The platen heater 5 can heat the recording region 29 to approximately 50° C. to 60° C. for evaporating a part of a volatile component of the ink discharged onto the recording target medium P on the recording region 29.

Infrared rays are desirably used as the electromagnetic waves and the wavelength thereof is 0.76 to 1000 μm. In general, the infrared rays are further classified into near infrared rays, middle infrared rays, and far infrared rays based on the wavelength. As the classification manner is defined variously, the wavelength ranges of the near infrared rays, the middle infrared rays, and the far infrared rays are approximately 0.78 to 2.5 μm, 2.5 to 4.0 μm, and 4.0 to 1000 μm, respectively. Among them, the middle infrared rays are preferably used.

A drying mechanism 17 is provided at the downstream side of the recording head 4 in the transportation direction A of the recording target medium P. The drying mechanism 17 dries the recording target medium P transported to a medium supporting portion 12 by an electromagnetic wave irradiator 7 as a so-called after-heater. The electromagnetic wave irradiator 7 is provided at a position opposing the medium supporting portion 12. In another expression, the drying mechanism 17 includes the electromagnetic wave irradiator 7 and the medium supporting portion 12. The electromagnetic wave irradiator 7 can emit the electromagnetic waves onto the recording target medium P on which recording has been performed by the recording head 4 on an irradiation region 18 as a region different from the recording region 29 in the transportation path. The medium supporting portion 12 supports the recording target medium P on the irradiation region 18. On the medium supporting portion, an irradiation region to which the electromagnetic waves are emitted by the electromagnetic wave irradiator and a non-irradiation region to which the electromagnetic waves are not emitted are generated.

When the medium supporting portion is manufactured using a material having high thermal conductivity, a ratio of released heat relative to heat transferred from the irradiation region is increased on the non-irradiation region and difference in the temperature between the irradiation region and the non-irradiation region is increased. Condensation of the steam evaporated from the ink is easy to occur on a part having a lower temperature on which the temperature is largely changed. Therefore, if the difference in the temperature between the irradiation region and the non-irradiation region is increased, the condensation is easy to occur on the non-irradiation region having the lower temperature. In particular, the condensation is easy to occur on the part of the medium supporting portion, which opposes the recording target medium.

As a result of enthusiastic study by the inventors, the medium supporting portion 12 has the thermal conductivity of equal to or higher than 0.057 w/(m·K) and equal to or lower than 2.2 w/(m·K). If the medium supporting portion 12 is set to have the thermal conductivity of this range, the difference in the temperature is not generated easily between the irradiation region 18 and a non-irradiation region 20 of the electromagnetic waves. That is to say, in this case, the steam evaporated from the ink is not easy to be condensed on the non-irradiation region 20. It is to be noted that the electromagnetic wave irradiator 7 capable of heating the irradiation region 18 to approximately 60° C. to 120° C. can be used, for example.

Further, the medium supporting portion 12 in the embodiment is configured to support the recording target medium P on the entire irradiation region 18 and the non-irradiation region 20. The non-irradiation region 20 is the region other than the irradiation region 18. Alternatively, the medium supporting portion may be configured to support the recording target medium on not the entire irradiation region but a part of the irradiation region and the non-irradiation region.

In addition, a tension adjusting portion 13 is provided at the downstream side of the drying mechanism 17 in the transportation direction A of the recording target medium P. The tension adjusting portion 13 has a function of adjusting tensile force of the recording target medium P when the recording target medium P is wound up. Further, the wind-up portion 14 is provided at the downstream side of the tension adjusting portion 13 in the transportation direction A of the recording target medium P. The wind-up portion 14 can wind up the recording target medium P. In the recording apparatus 1 in the embodiment, when a roll R2 for the recording target medium P is formed, the wind-up portion 14 rotates in the rotating direction C.

Next, the medium supporting portion 12 is described more in detail.

Figure 2:
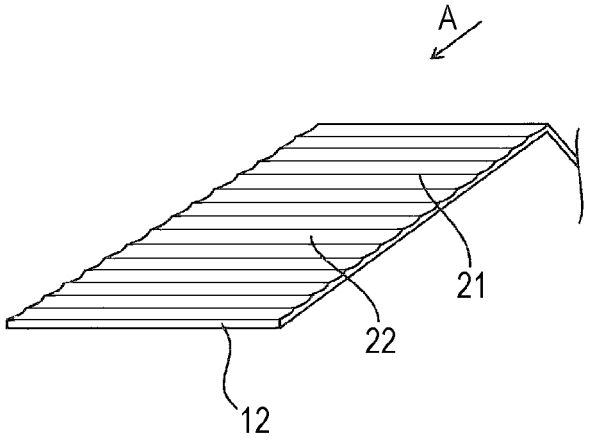
FIG. 2 is a schematic perspective view illustrating a medium supporting portion in the recording apparatus according to the first embodiment of the invention.

FIG. 2 is a schematic perspective view illustrating the medium supporting portion 12 in the recording apparatus 1 in the embodiment.

The medium supporting portion 12 in the embodiment is provided with projections 21 and recesses 22. The projections 21 and the recesses 22 extend in the direction intersecting with the transportation direction A. The recording target medium P is transported in the transportation path on the medium supporting portion 12 in the transportation direction A while making contact with the projections 21 and not making contact with the recesses 22. That is to say, the recording target medium P is transported while making line-contact with the projections 21 provided on the medium supporting portion 12. Therefore, the medium supporting portion 12 has a configuration capable of reducing the friction force when the recording target medium is transported in comparison with a recording apparatus that transports the recording target medium while the recording target medium is made to make surface-contact with the medium supporting portion.

On the other hand, it can be considered that the medium supporting portion 12 including the projections 21 that make contact with the recording target medium P and the recesses 22 that do not make contact with the recording target medium P like the medium supporting portion 12 in the embodiment has a configuration in which liquid is easy to be accumulated in the recesses 22. If the ink on the recording target medium P on which recording has been performed is evaporated, the steam is condensed, and the liquid is accumulated in the recesses 22, there is a risk that the liquid contaminates the recording target medium.

In particular, when the irradiation region 18 and the non-irradiation region 20 of the electromagnetic waves by the electromagnetic wave irradiator 7 are present as in the recording apparatus 1 in the embodiment, the temperature of the non-irradiation region 20 is easy to be lower than the temperature of the irradiation region 18. It can be considered that the condensed liquid is easy to be accumulated in the recesses 22 on the non-irradiation region 20.

However, the medium supporting portion 12 in the embodiment has the thermal conductivity of equal to or higher than 0.057 w/(m·K) and equal to or lower than 2.2 w/(m·K). That is to say, the medium supporting portion 12 has the low thermal conductivity and the difference in the temperature between the region to which the electromagnetic waves are emitted and the region to which the electromagnetic waves are not emitted is small. This suppresses condensation of the steam evaporated from the ink with the electromagnetic wave irradiation by the electromagnetic wave irradiator 7 on the medium supporting portion 12. Accordingly, the accumulation itself of the liquid in the recesses 22 can be suppressed even when the projections 21 and the recesses 22 are provided, thereby reducing the risk that the liquid contaminates the recording target medium P.

The thermal conductivity of the medium supporting portion 12 is preferably equal to or lower than 0.7 w/(m·K), and more preferably equal to or lower than 0.3 w/(m·K).

When the thermal conductivity is higher than 2.2 w/(m·K), heat that is released from the region to which the electromagnetic waves are not emitted is increased because the thermal conductivity is high. Therefore, in this case, the difference in the temperature between the region to which the electromagnetic waves are emitted and the region to which the electromagnetic waves are not emitted is increased. On the other hand, when the thermal conductivity is lower than 0.057 w/(m·K), heat that is transferred to the region to which the electromagnetic waves are not emitted from the region to which the electromagnetic waves are emitted is too small because the thermal conductivity is too low. Therefore, in this case, the difference in the temperature between the region to which the electromagnetic waves are emitted and the region to which the electromagnetic waves are not emitted is increased in some cases.

As a constituent material of the medium supporting portion 12 for obtaining the thermal conductivity of equal to or higher than 0.057 w/(m·K) and equal to or lower than 2.2 w/(m·K), glass wool, urethane rubber, vinyl chloride compound, polyether ether ketone (PEEK), polyphenylene sulfide (PPS), Bakelite, silica glass, and the like can be exemplified. Further, a reinforcing member such as a glass fiber and a carbon fiber may be added to these materials. From the viewpoint of easiness of processing and the like, a plastic material is preferably used among them, in particular, PEEK, PPS, and Bakelite are preferably used.

These constituent materials have high heat resistant temperatures (heat resistant temperatures by the ASTM D-648 test method) and can be preferably used.

The heat resistant temperature by the ASTM D-648 test method is preferably equal to or higher than 60° C., more preferably equal to or higher than 80° C., and particularly preferably equal to or higher than 120° C. As the heat resistant temperature is higher, the intensity of the electromagnetic wave irradiation by the electromagnetic wave irradiator 7 can be increased. Therefore, as the heat resistant temperature is higher, the ink on the recording target medium P on which recording has been performed can be dried more efficiently. Further, for example, when the heat resistant temperature is equal to or higher than 120° C., ink containing curable resin that cures at approximately 120° C. can be used. That is to say, as the heat resistant temperature is higher, the number of types of ink components capable of being used is increased, so that various inks can be used.

Figure 3:
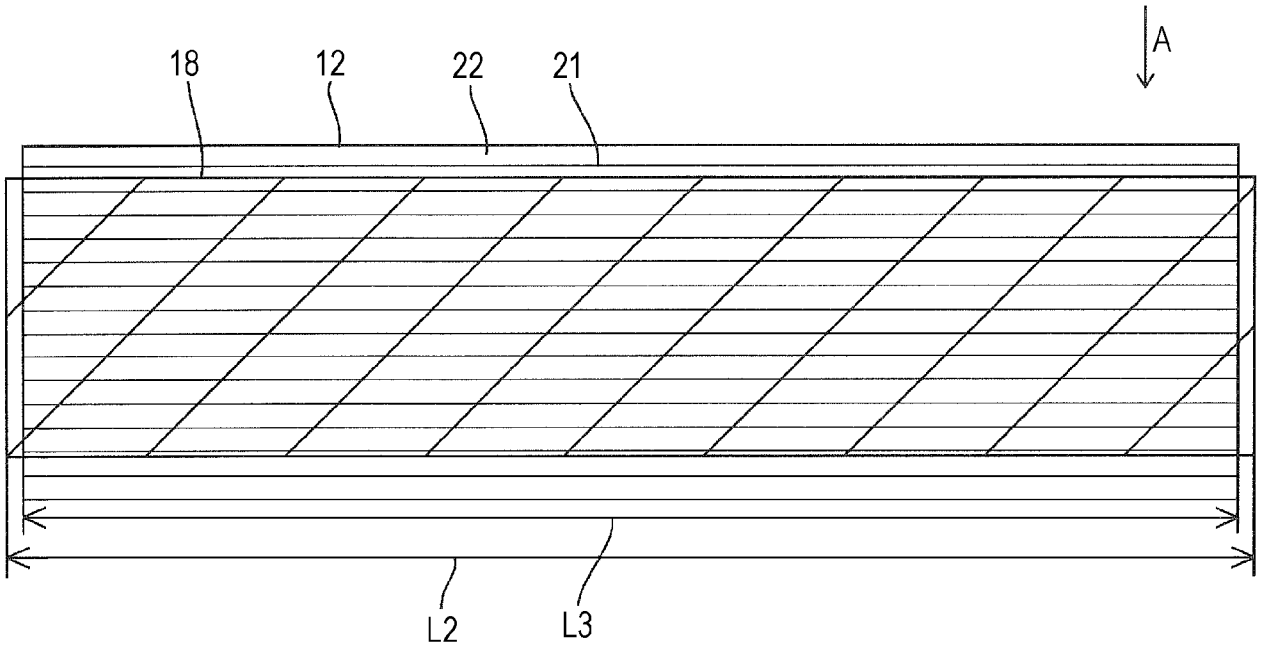
FIG. 3 is a schematic plan view illustrating the medium supporting portion in the recording apparatus according to the first embodiment of the invention.

As indicated by the irradiation region 18 of the electromagnetic waves by the electromagnetic wave irradiator 7 in FIG. 3, an irradiation length L2 of the electromagnetic waves by the electromagnetic wave irradiator 7 in the intersecting direction intersecting with the transportation direction A corresponds to a length L3 of the medium supporting portion 12 in the intersecting direction.

The expression "length L3 of the medium supporting portion 12 in the intersecting direction" may be a length including an outer frame when the medium supporting portion 12 includes the outer frame or the like or may be a length excluding the outer frame.

The expression "corresponds to a length L3 of the medium supporting portion 12 in the intersecting direction" indicates that the irradiation length is equivalent to or larger than the length of the medium supporting portion 12 in the intersecting direction. The term "equivalent" indicates to also include the case where the irradiation length is slightly smaller than the length of the medium supporting portion 12 in the intersecting direction.

In the recording apparatus 1 in the embodiment, the irradiation length L2 of the electromagnetic waves by the electromagnetic wave irradiator 7 in the intersecting direction corresponds to the length L3 of the medium supporting portion 12 in the intersecting direction. Therefore, the difference in the temperature of the medium supporting portion 12 in the intersecting direction is decreased, thereby suppressing generation of condensation on end portions and the like of the medium supporting portion 12 in the intersecting direction.

EXAMPLES

The medium supporting portion 12 of the recording apparatus 1 in the embodiment was formed by each of constituent materials in Examples 1 to 7 and Comparison Examples 1 and 2 in the following Table 1. Presence and absence of generation of condensation and warpage (thermal deformation) of the medium supporting portion 12 when the intensity of the electromagnetic wave irradiation was adjusted such that the medium supporting portion 12 was 60° C., 80° C., or 120° C. were evaluated.

The following Table 1 indicates the constituent materials, the thermal conductivities, the heat resistant temperatures (ASTM D-648 test method), and the above-mentioned evaluation results in Examples 1 to 7 and Comparison Examples 1 and 2.

The evaluation standards for the presence and absence of the generation of the condensation and the warpage of the medium supporting portion (deformation by softening due to low heat resistant temperature) are as follows and the unevaluated items are indicated as "-" in Table 1.

Generation of Condensation

Condensation to an extent that the recording target medium being contaminated was not generated: A Condensation was generated: C Warpage of Medium Supporting Portion Warpage was not generated: A Slight warpage to an extent with no problem was generated: B Obvious warpage was generated: C

TABLE 1

| | CONSTITUENT MATERIAL | THERMAL CONDUCTIVITY [W/(m · K] | HEAT RESISTANT TEMPERATURE (° C.) | CONDENSATION | WARPAGE OF MEDIUM SUPPORTING PORTION 60° C. | 80° C. | 120° C. |
|---|---|---|---|---|---|---|---|
| EXAMPLE 1 | GLASS WOOL | 0.057 | 600 | A | A | A | A |
| EXAMPLE 2 | URETHANE RUBBER | 0.12 | 70 | A | B | C | C |
| EXAMPLE 3 | VINYL CHLORIDE COMPOUND | 0.16 | 60-80 | A | B | B | C |
| EXAMPLE 4 | PEEK | 0.25 | 180 | A | A | A | A |
| EXAMPLE 5 | PPS | 0.29 | 200 | A | A | A | A |
| EXAMPLE 6 | BAKELITE | 0.33-0.67 | 150-180 | A | A | A | A |
| EXAMPLE 7 | SILICA GLASS | 1.3-2.2 | 1000 | A | A | A | A |
| COMPARISON EXAMPLE 1 | ALUMINUM ALLOY | 206 | — | C | — | — | — |
| COMPARISON EXAMPLE 2 | STAINLESS | 16-26 | — | C | — | — | — |

Thus, generation of condensation was able to be suppressed effectively in Examples 1 to 7.

The medium supporting portions in Examples 1 to 7 and Comparison Examples 1 and 2 as described above included no opening as illustrated in FIG. 2. Further, as Example 8, generation of condensation was evaluated for the following medium supporting portion in the same manner as described above. That is, the evaluation was performed for the medium supporting portion of which constituent material was stainless having the thermal conductivity of 30 W/(m·K) and which was provided with openings having an aperture ratio of 40% like a medium supporting portion 6 in the following second embodiment. Then, the evaluation result "A" was obtained.

That is to say, it was found that when the openings through which the steam passes to the medium supporting portion are provided, generation of condensation can be suppressed effectively if the thermal conductivity thereof is equal to or higher than 0.057 w/(m·K) and equal to or lower than 30 w/(m·K).

Any recording target medium P can be used without being limited particularly. For example, the recording target medium P having a low thermal conductivity, such as a cotton fabric, a silk fabric, a wool fabric, a polyester fabric, leather, and paper, can be preferably used.

The following Table 2 indicates the thermal conductivities of these recording target media.

TABLE 2

| RECORDING TARGET MEDIUM TYPE | THERMAL CONDUCTIVITY [W/(m · K)] |
|---|---|
| COTTON FABRIC | 0.036 to 0.083 |
| SILK FABRIC | 0.042 |
| WOOL FABRIC | 0.04 |
| POLYESTER FABRIC | 0.042 to 0.064 |
| LEATHER | 0.16 |
| PAPER | 0.06 |

Second Embodiment

FIG. 4 and FIG. 5

Hereinafter, a recording apparatus in the second embodiment is described in detail with reference to the accompanying drawings.

Figure 4:
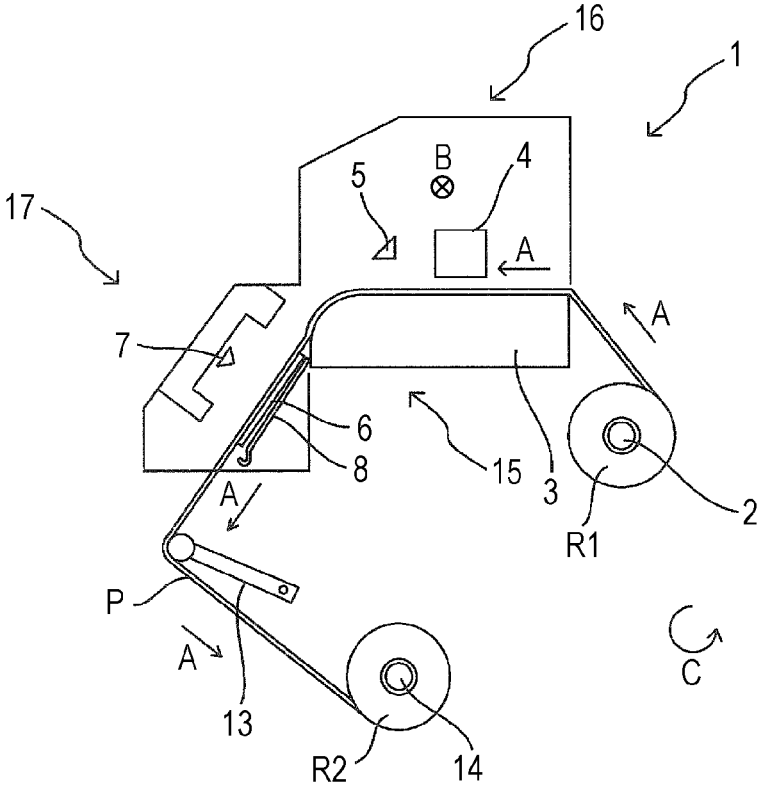
FIG. 4 is a schematic side view illustrating a recording apparatus according to a second embodiment of the invention.
Figure 5:
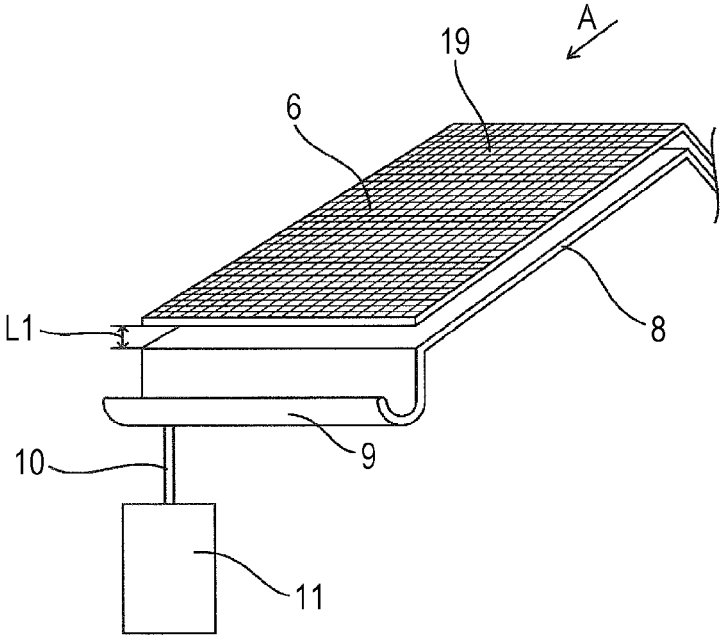
FIG. 5 is a schematic perspective view illustrating a medium supporting portion and a condensation portion in the recording apparatus according to the second embodiment of the invention.

FIG. 4 is a schematic side view illustrating the recording apparatus 1 in the embodiment. FIG. 5 illustrates the medium supporting portion 6 and a condensation portion 8 in the recording apparatus 1 in the embodiment. It is to be noted that the same reference numerals denote the constituent members common to those in the above-mentioned embodiment and detailed description thereof is omitted.

The recording apparatus in the embodiment is different from the recording apparatus in the first embodiment in the following point. That is, in the recording apparatus in the embodiment, the drying mechanism 17 includes the medium supporting portion 6 in which openings 19 are provided instead of the medium supporting portion 12, and the condensation portion 8 at the lower side of the medium supporting portion 6.

The medium supporting portion 6 in the embodiment is provided with the openings 19. Steam evaporated from ink with which recording has been performed on the recording target medium P with the electromagnetic wave irradiation by the electromagnetic wave irradiator 7 can pass through the openings 19 from the recording target medium P side with respect to the medium supporting portion 6 to the opposite side.

By providing the openings 19, the steam evaporated from the ink with the electromagnetic wave irradiation can be released through the opening 19 in the direction of being farther from a portion of the medium supporting portion 6 which opposes the recording target medium P, that is, the contact region between the medium supporting portion 6 and the recording target medium P. With this, condensation of the steam evaporated from the ink with the electromagnetic wave irradiation on the portion of the medium supporting portion 6, which opposes the recording target medium P, can be suppressed more effectively.

The drying mechanism 17 in the embodiment includes the condensation portion 8 on which the steam that has passed through the openings 19 is condensed. Therefore, the steam evaporated from the ink can be condensed on the condensation portion 8 before the steam is condensed on the medium supporting portion 6. That is to say, condensation of the steam evaporated from the ink with the electromagnetic wave irradiation on the medium supporting portion 6 can be suppressed more effectively. It should be noted that the drying mechanism 17 may not include the condensation portion 8.

The medium supporting portion 6 in the embodiment is made of a material having the thermal conductivity of equal to or higher than 0.057 w/(m·K) and equal to or lower than 2.2 w/(m·K) as in the medium supporting portion 12. Further, the condensation portion 8 is preferably made of a constituent material having the thermal conductivity higher than that of the medium supporting portion 6.

That is to say, the condensation portion 8 is made of the material that causes the steam to be condensed easily thereon in comparison with the medium supporting portion 6. Therefore, the steam evaporated from the ink with the electromagnetic wave irradiation can be condensed on the condensation portion 8 effectively. The effective condensation lowers the concentration of the steam in the vicinity of the medium supporting portion 6. This can suppress condensation on the medium supporting portion 6 effectively.

As the preferable constituent material of the condensation portion 8, aluminum, aluminum alloy, and the like can be exemplified from the viewpoint of easiness of the processing and cost.

The condensation portion 8 in the embodiment is a constituent member that causes the steam which has passed through the openings 19 to be condensed thereon. A liquid receiver 9 is provided on a lower portion of the condensation portion 8 as illustrated in FIG. 5. The liquid receiver 9 receives liquid droplets generated by the condensation of the steam. Further, a waste liquid bottle 11 is provided at the lower side of the liquid receiver 9. The waste liquid bottle 11 is a member for collecting the liquid accumulated in the liquid receiver 9 through a tube 10.

It is to be noted that the shape and the like of the openings 19 of the medium supporting portion 6 are not particularly limited and the openings 19 may be configured into a circular shape, a polygonal shape, or another shape as long as the steam can pass through the openings 19.

As the preferable configuration of the openings 19, the square shape formed by arranging linear members at least a part of which has a diameter of equal to smaller than 0.3 mm in a grid form can be exemplified. A region having a certain area is necessary for causing the steam to be condensed. The area other than the openings can be reduced by configuring the openings using the linear members at least a part of which has the diameter of equal to smaller than 0.3 mm. Therefore, the region having the certain area can be reduced, thereby suppressing condensation of the steam on the contact portion of the medium supporting portion 6 with the recording target medium P with high accuracy.

Further, the aperture ratio of the openings 19 relative to the medium supporting portion 6 is preferably equal to or higher than 40%. If the aperture ratio is set like this, condensation of the steam on the medium supporting portion 6 can be suppressed with high accuracy.

The temperature conductivity of the condensation portion 8 is preferably higher than the temperature conductivity of the medium supporting portion 6. The temperature conductivity is obtained by dividing the thermal conductivity by the density and the specific heat capacity. Therefore, when the temperature conductivity of the condensation portion 8 is higher than the temperature conductivity of the medium supporting portion 6, heat is easier to be released from the condensation portion 8 and the temperature of the condensation portion 8 is easier to be low in comparison with the medium supporting portion 6. The condensation portion 8 and the medium supporting portion 6 have this relation in terms of the temperature conductivity, thereby suppressing condensation of the steam on the medium supporting portion 6 with high accuracy as in the case where the thermal conductivity of the condensation portion 8 is higher than the thermal conductivity of the medium supporting portion 6.

A contact angle formed between the condensation portion 8 and liquid droplets generated by the condensation of the steam is preferably smaller than that between the medium supporting portion 6 and the liquid droplets. With this, the condensation portion 8 becomes easier to get wet rather than the medium supporting portion 6, thereby suppressing condensation of the steam on the medium supporting portion 6 with high accuracy.

Further, the condensation portion 8 in the embodiment is arranged such that an interval L1 between the condensation portion 8 and the medium supporting portion 6 is preferably equal to or larger than 2 mm and equal to or smaller than 20 mm. When the interval L1 between the condensation portion 8 and the medium supporting portion 6 is not constant, the condensation portion 8 is preferably arranged such that the interval L1 is equal to or larger than 2 mm and equal to or smaller than 20 mm on any portions. If the interval L1 between the condensation portion 8 and the medium supporting portion 6 is equal to or larger than 2 mm, attachment of liquid droplets condensed on the condensation portion 8 to the medium supporting portion 6 can be suppressed. Further, if the interval L1 between the condensation portion 8 and the medium supporting portion 6 is equal to or smaller than 20 mm, condensation of the steam on the medium supporting portion 6 can be suppressed with high accuracy.

Third Embodiment

FIG. 6

Hereinafter, a recording apparatus in a third embodiment is described in detail with reference to the accompanying drawing.

Figure 6:
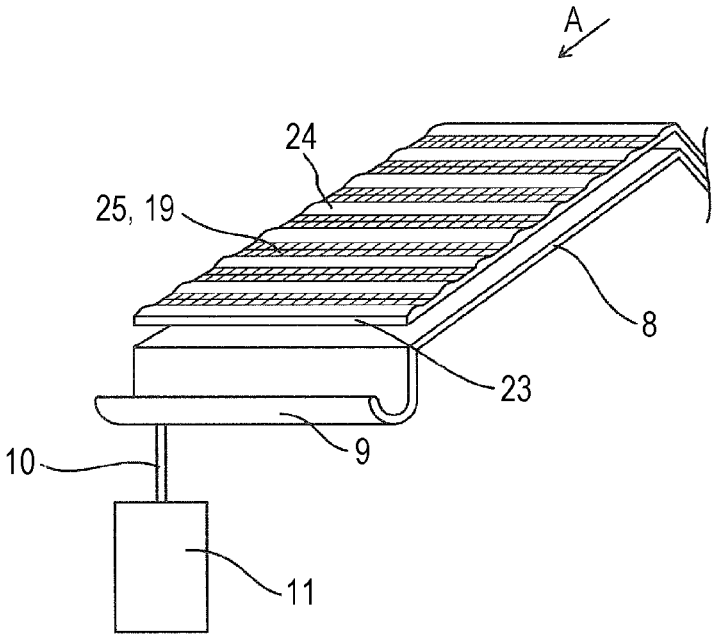
FIG. 6 is a schematic perspective view illustrating a medium supporting portion and a condensation portion in a recording apparatus according to a third embodiment of the invention.

FIG. 6 illustrates a medium supporting portion 23 and the condensation portion 8 in the recording apparatus 1 in the embodiment. It is to be noted that the same reference numerals denote the constituent members common to those in the above-mentioned embodiments and detailed description thereof is omitted.

The recording apparatus in the embodiment is different from the recording apparatus in the second embodiment in the following point. That is, in the recording apparatus in the embodiment, the drying mechanism 17 includes the medium supporting portion 23 instead of the medium supporting portion 6 in the second embodiment.

The medium supporting portion 23 includes contact portions 24 and non-contact portions 25. The contact portions 24 make line-contact with the recording target medium P that is transported in the transportation direction A in the direction intersecting with the transportation direction A. The non-contact portions 25 include the openings 19 and do not make contact with the recording target medium P. To be specific, the contact portions 24 and the non-contact portions 25 are provided to extend in the direction intersecting with the transportation direction A and are provided to be positioned alternately in the transportation direction A. Therefore, the medium supporting portion 23 can make line-contact with the recording target medium P that is transported in the transportation direction A. That is to say, the medium supporting portion 23 has a configuration capable of reducing the friction force when the recording target medium is transported in comparison with a recording apparatus that transports the recording target medium while the recording target medium P is made to make surface-contact with the medium supporting portion.

The non-contact portions 25 have the thermal conductivity higher than that of the contact portions 24. Further, the condensation portion 8 has the thermal conductivity higher than that of the non-contact portions 25. With this configuration, the recording apparatus in the embodiment suppresses condensation of steam on the medium supporting portion 23 with higher accuracy than the recording apparatus in the second embodiment.

Fourth Embodiment

FIG. 7

Hereinafter, a recording apparatus in a fourth embodiment is described in detail with reference to the accompanying drawing.

Figure 7:
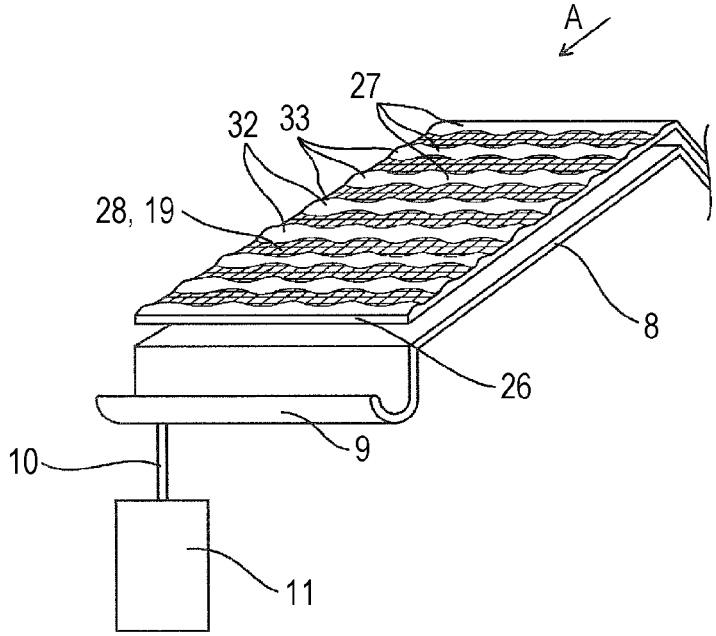
FIG. 7 is a schematic perspective view illustrating a medium supporting portion and a condensation portion in a recording apparatus according to a fourth embodiment of the invention.

FIG. 7 illustrates a medium supporting portion 26 and the condensation portion 8 in the recording apparatus 1 in the embodiment. It is to be noted that the same reference numerals denote the constituent members common to those in the above-mentioned embodiments and detailed description thereof is omitted.

The recording apparatus in the embodiment is different from the recording apparatus in the second embodiment in the following point. That is, in the recording apparatus in the embodiment, the drying mechanism 17 includes the medium supporting portion 26 instead of the medium supporting portion 6.

The medium supporting portion 26 includes contact portions 27 and non-contact portions 28. The contact portions 27 are configured by arranging a plurality of projections in the intersecting direction intersecting with the transportation direction A. The non-contact portions 28 include the openings 19 and do not make contact with the recording target medium P.

The plurality of projections 32 of the contact portions 27 are arranged in the intersecting direction while the adjacent projections 32 make contact with each other partially. Apexes 33 of the projections 32 can make contact with the recording target medium P that is transported in the transportation direction A. That is to say, the medium supporting portion 26 can make point-contact with the recording target medium P that is transported in the transportation direction A at a plurality of places (apexes 33 of the plurality of projections 32). Therefore, the medium supporting portion 26 has a configuration capable of reducing the friction force when the recording target medium is transported in comparison with a recording apparatus that transports the recording target medium P while the recording target medium P is made to make surface-contact or line-contact with the medium supporting portion.

The non-contact portions 28 have the thermal conductivity higher than that of the contact portions 27. Further, the condensation portion 8 has the thermal conductivity higher than that of the non-contact portions 28. With this configuration, the recording apparatus in the embodiment suppresses condensation of steam on the medium supporting portion 26 with higher accuracy than the recording apparatus in the second embodiment.

Fifth Embodiment

FIG. 8

Hereinafter, a recording apparatus in a fifth embodiment is described in detail with reference to the accompanying drawing.

Figure 8:
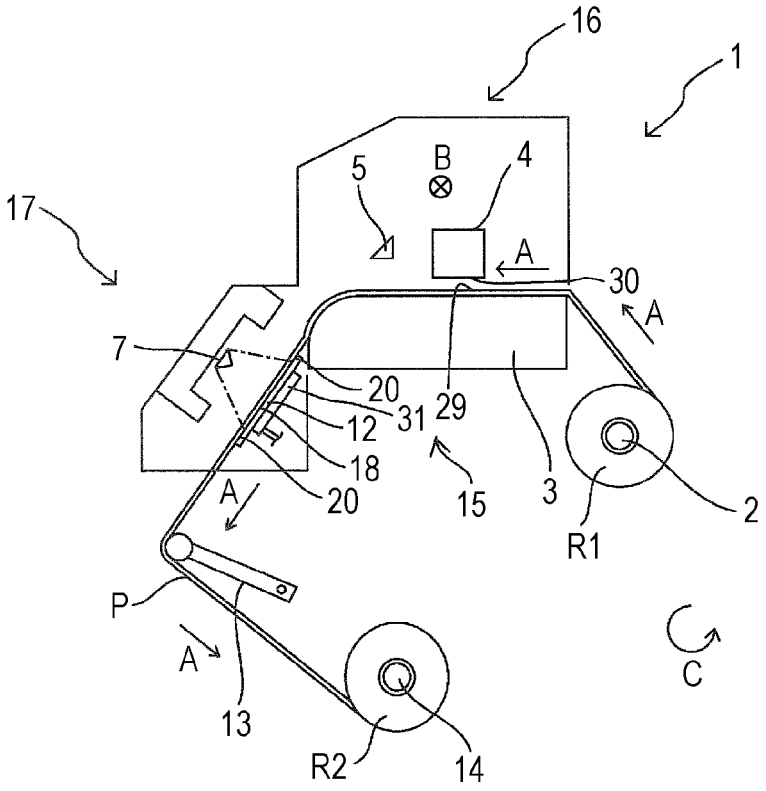
FIG. 8 is a schematic side view illustrating a recording apparatus according to a fifth embodiment of the invention.

FIG. 8 is a schematic side view illustrating the recording apparatus 1 in the embodiment. It is to be noted that the same reference numerals denote the constituent members common to those in the above-mentioned embodiments and detailed description thereof is omitted.

The recording apparatus in the embodiment is different from the recording apparatus in the first embodiment in the following point. That is, in the recording apparatus in the embodiment, the rear side of the supporting surface of the medium supporting portion 12, which supports the recording target medium P, makes contact with a heat conductive member 31 in the drying mechanism 17.

The rear side of the supporting surface of the medium supporting portion 12 in the embodiment, which supports the recording target medium P, makes contact with the heat conductive member 31. The heat conductive member 31 is connected to a housing of the recording apparatus 1 with a connecting portion (not illustrated). Therefore, the heat conductive member 31 can absorb heat of the medium supporting portion 12 so as to improve the heat dissipation property of the medium supporting portion 12. That is to say, for example, heat dissipation time from time at which the recording apparatus is powered OFF can be reduced. The heat conductive member can be made of copper, aluminum, aluminum alloy, or the like.

As described above in the first to fifth embodiments, the recording apparatus according to the invention includes the electromagnetic wave irradiator that emits electromagnetic waves onto the recording target medium and heats it and the medium supporting portion that supports the recording target medium on which recording has been performed on the irradiation region of the electromagnetic wave irradiator and has the thermal conductivity of equal to or higher than 0.057 w/(m·K) and equal to or lower than 2.2 w/(m·K).

Alternatively, the recording apparatus according to the invention includes the electromagnetic wave irradiator that emits electromagnetic waves onto the recording target medium and heats it and the medium supporting portion that supports the recording target medium on which recording has been performed on the irradiation region of the electromagnetic wave irradiator, has the thermal conductivity of equal to or higher than 0.057 w/(m·K) and equal to or lower than 30 w/(m·K), and is provided with the openings through which steam evaporated from the ink discharged onto the recording target medium with electromagnetic wave irradiation by the electromagnetic wave irradiator passes.

The expression "supports the recording target medium on which recording has been performed" indicates that the medium supporting portion supports the target medium in a state where a recording operation on the recording target medium has been completed. That is, the expression does not include the medium supporting portion supporting the recording target medium in a state where the recording operation on the recording target medium is being performed.

With these characteristics, the medium supporting portion has the thermal conductivity that is lower than the thermal conductivity of the existing medium supporting portion made of aluminum alloy, which is approximately 230 w/(m·K), for example. This can decrease difference in the temperature between the region to which the electromagnetic waves are emitted and the region to which the electromagnetic waves are not emitted. That is to say, condensation of the steam evaporated from the ink with the electromagnetic wave irradiation on the medium supporting portion can be suppressed.

In another expression, the recording apparatus according to the invention includes the electromagnetic wave irradiator 7 that performs heating operation using the electromagnetic waves and the medium supporting portion 6 that supports the recording target medium P on which recording has been performed on the irradiation region 18 of the electromagnetic wave irradiator 7. In the recording apparatus, the medium supporting portion 6 is configured to reduce condensation of steam evaporated from the ink discharged onto the recording target medium P with the electromagnetic wave irradiation by the electromagnetic wave irradiator 7 on a portion of the medium supporting portion 6 which opposes the recording target medium P.

The expression "configured to reduce condensation" is used not to indicate that the steam is required not to be condensed on the medium supporting portion at all but to indicate as follows. That is, condensation to an extent that liquid condensed on the medium supporting portion is not recognized as contaminants raises no problem even if the liquid attaches to the recording target medium.

With these characteristics, condensation of the steam evaporated from the ink with the electromagnetic wave irradiation on the medium supporting portion can be suppressed.

The entire disclosure of Japanese Patent Application No. 2013-142409, filed Jul. 8, 2013 is expressly incorporated by reference herein.

What is claimed is:

1. A recording apparatus comprising:

a medium supporting portion that supports a recording target medium, the medium supporting portion including an opening;

an electromagnetic wave irradiator that emits electromagnetic waves including infrared radiation onto the recording target medium on the medium supporting portion and dries ink present on the recording target medium using the electromagnetic waves; and a condensation portion that causes steam which has passed through the opening to be condensed on the condensation portion, the medium supporting portion being stationary with respect to the condensation portion, wherein the medium supporting portion has a thermal conductivity of equal to or higher than 0.057 w/(m·K) and equal to or lower than 2.2 w/(m·K), wherein the medium supporting portion is stationary with respect to the electromagnetic wave irradiator during transport of the recording target medium on the medium supporting portion.

2. The recording apparatus according to claim 1, wherein a heat resistant temperature of the medium supporting portion is equal to or higher than 60° C.

3. The recording apparatus according to claim 1, wherein a rear side of a supporting surface of the medium supporting portion which supports the recording target medium makes contact with a heat conductive member.

4. The recording apparatus according to claim 1, further comprising a transportation mechanism that transports the recording target medium, wherein the medium supporting portion includes a contact portion that makes contact with and supports the recording target medium and a non-contact portion that does not make contact with the recording target medium and is provided with the opening, and the contact portion and the non-contact portion are provided to extend in an intersecting direction intersecting with a transportation direction of the recording target medium by the transportation mechanism and are provided to be positioned alternately in the transportation direction.

5. The recording apparatus according to claim 4, wherein the contact portion is formed by arranging a plurality of projections having apexes that make contact with the recording target medium.

6. The recording apparatus according to claim 1, further comprising a transportation mechanism that transports the recording target medium, wherein an irradiation length of the electromagnetic waves by the electromagnetic wave irradiator in the intersecting direction intersecting with the transportation direction of the recording target medium by the transportation mechanism is equivalent to or larger than a length of the medium supporting portion in the intersecting direction.

7. A recording apparatus, comprising:

a medium supporting portion that supports a recording target medium, the medium supporting portion including an opening;

an electromagnetic wave irradiator that emits electromagnetic waves including infrared radiation onto the recording target medium on the medium supporting portion and dries ink present on the recording target medium using the electromagnetic waves; and a condensation portion that causes steam, evaporated from ink discharged onto the recording target medium with electromagnetic wave irradiation by the electromagnetic wave irradiator, which has passed through the opening to be condensed on the condensation portion, the medium supporting portion being stationary with respect to the condensation portion, wherein the medium supporting portion has a thermal conductivity of equal to or higher than 0.057 w/(m·K) and equal to or lower than 30 w/(m·K), and wherein the medium supporting portion is stationary with respect to the electromagnetic wave irradiator during transport of the recording target medium on the medium supporting portion.

8. The recording apparatus according to claim 7, wherein a thermal conductivity of the condensation portion is higher than the thermal conductivity of the medium supporting portion.

9. A recording apparatus comprising:

an electromagnetic wave irradiator that performs heating operation using electromagnetic waves including infrared radiation; and a medium supporting portion that supports a recording target medium on which recording has been performed on an irradiation region of the electromagnetic wave irradiator, the medium supporting portion including an opening; and a condensation portion that causes steam which has passed through the opening to be condensed on the condensation portion, the medium supporting portion being stationary with respect to the condensation portion, wherein the medium supporting portion is configured to reduce condensation of the steam evaporated from ink discharged onto the recording target medium with electromagnetic wave irradiation by the electromagnetic wave irradiator on a portion of the medium supporting portion which opposes the recording target medium wherein the medium supporting portion is stationary with respect to the electromagnetic wave irradiator during transport of the recording target medium on the medium supporting portion.

10. The recording apparatus according to claim 9, wherein the medium supporting portion is made of a plastic material.

11. The recording apparatus according to claim 10, wherein the plastic material is any one of polyether ether ketone, polyphenylene sulfide, and Bakelite.

* * * * *